US009279640B1

(12) United States Patent
Hurley et al.

(10) Patent No.: US 9,279,640 B1
(45) Date of Patent: Mar. 8, 2016

(54) WEAPON STOCK INTEGRATED NETWORK USER EQUIPMENT HOLDER

(71) Applicants: Mathew James Hurley, Framingham, MA (US); Lester Martin Ringler, Needham, MA (US)

(72) Inventors: Mathew James Hurley, Framingham, MA (US); Lester Martin Ringler, Needham, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/466,220

(22) Filed: Aug. 22, 2014

Related U.S. Application Data

(60) Provisional application No. 61/869,206, filed on Aug. 23, 2013.

(51) Int. Cl.
*F41C 23/22* (2006.01)

(52) U.S. Cl.
CPC ..... *F41C 23/22* (2013.01)

(58) Field of Classification Search
CPC ..... F41C 23/00; F41C 23/06; F41C 23/12; F41C 23/14; F41C 23/22
USPC ..... 42/71.01, 72, 73, 74, 75.01, 75.03; D22/100, 101, 102, 103, 104, 108
See application file for complete search history.

(56) References Cited

U.S. PATENT DOCUMENTS

| | | | | |
|---|---|---|---|---|
| 1,456,482 | A * | 5/1923 | Berthier | 89/140 |
| 2007/0115955 | A1* | 5/2007 | Byer et al. | 370/360 |
| 2007/0261284 | A1* | 11/2007 | Keng | 42/73 |
| 2010/0242334 | A1* | 9/2010 | Kincel | 42/74 |
| 2011/0099872 | A1* | 5/2011 | Bentley et al. | 42/71.01 |
| 2011/0173863 | A1* | 7/2011 | Ingram | 42/73 |
| 2012/0042559 | A1* | 2/2012 | Bockmon | 42/111 |
| 2012/0174456 | A1* | 7/2012 | DePierro et al. | 42/71.01 |
| 2013/0263489 | A1* | 10/2013 | Troy et al. | 42/71.01 |

FOREIGN PATENT DOCUMENTS

WO WO 2008097308 A2 * 8/2008 ..... F41C 23/22

* cited by examiner

*Primary Examiner* — Bret Hayes
(74) *Attorney, Agent, or Firm* — Roger C. Phillips

(57) ABSTRACT

Apparatuses are provided that include a rifle stock. For example, in one embodiment the stock includes an upper portion. The upper portion includes a proximal end and a distal end. A front portion and a rear portion are connected to the proximal end and the distal end of the upper portion, respectively. A bottom portion is connected to the front portion and rear portion. A first sidewall and a second sidewall are connected to the upper portion, the front portion, the rear portion, and the bottom portion. A channel is provided between the first and second sidewall. The upper portion, the front portion, the rear portion, and the bottom portion further define the channel. The first and second sidewalls include openings for accessing a computer device residing in the channel.

7 Claims, 9 Drawing Sheets

Fig. 7
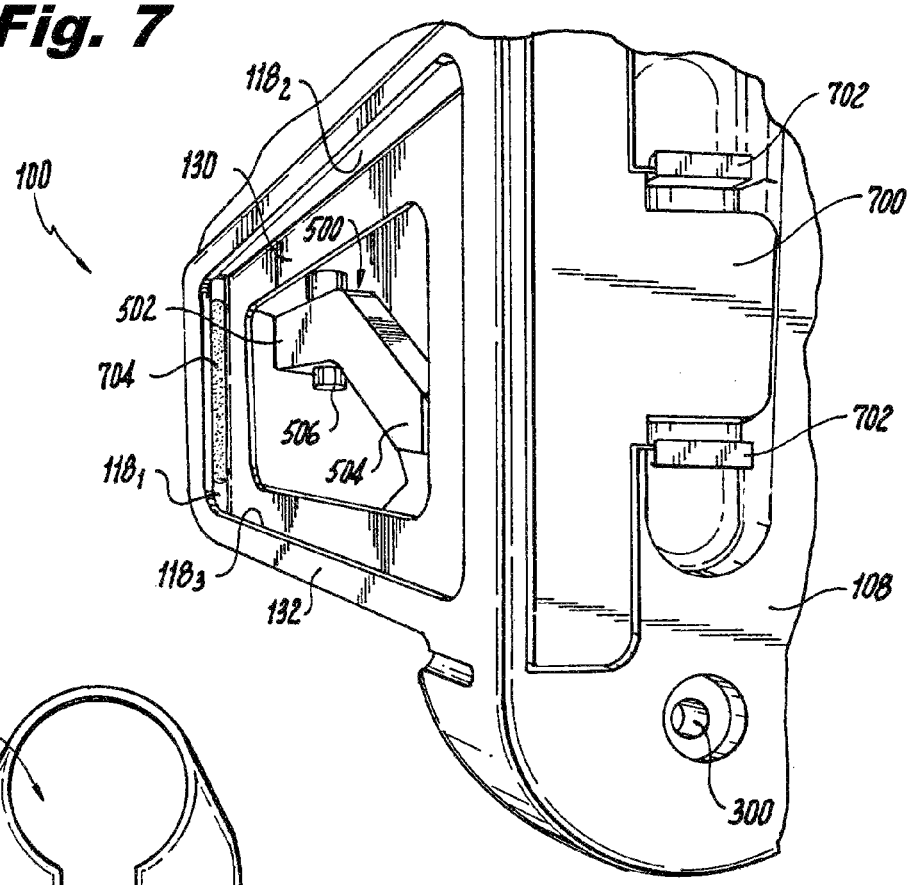
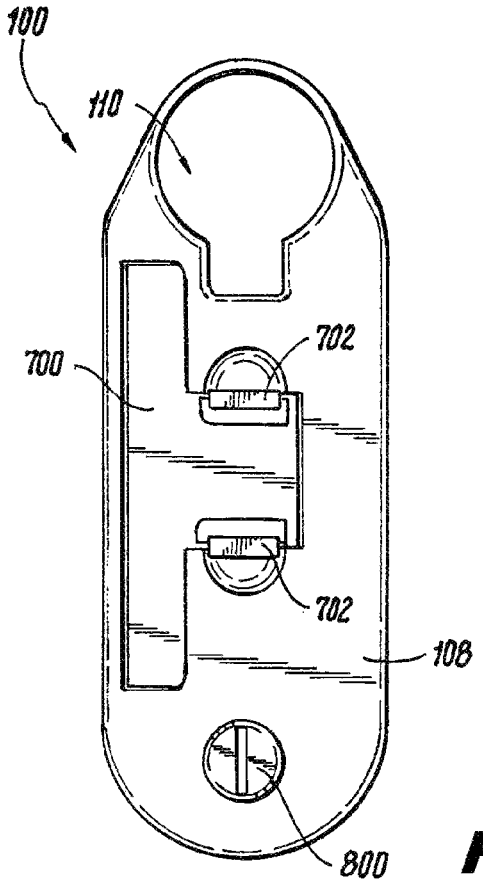
Fig. 8

Fig. 12
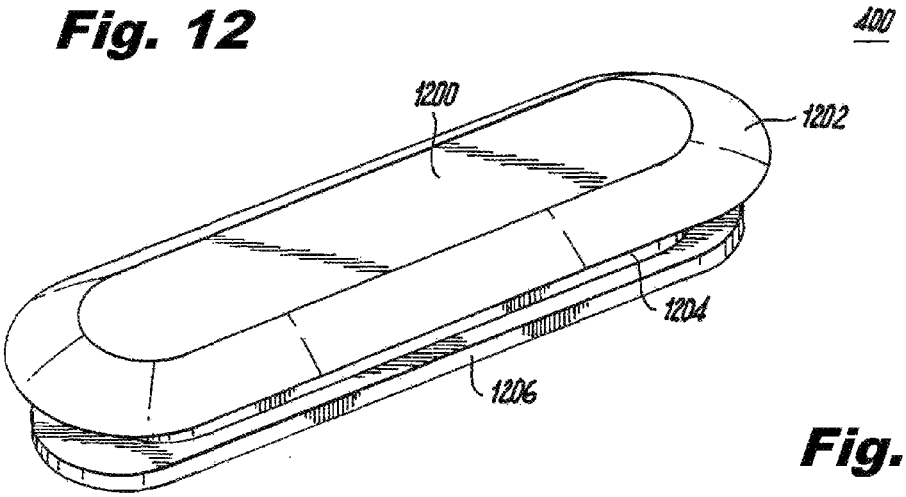
Fig. 13
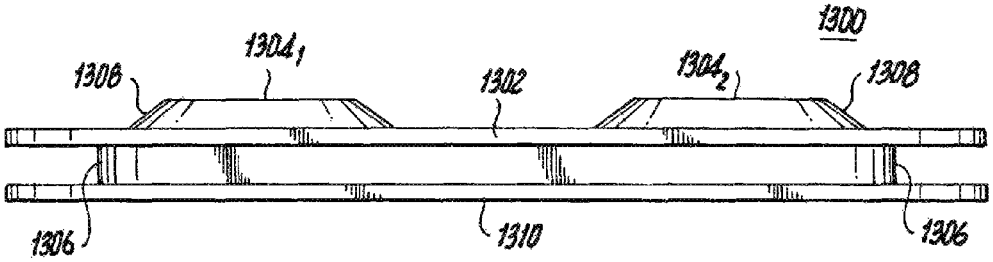
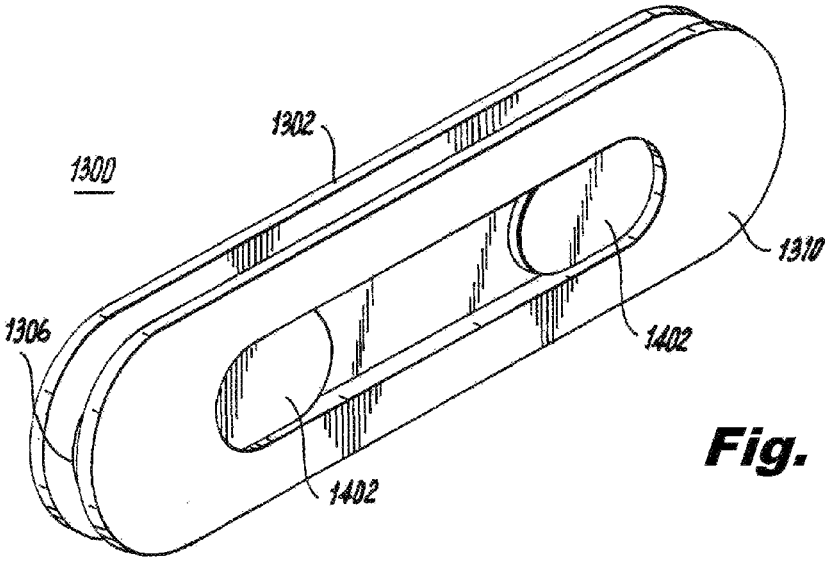
Fig. 14

WEAPON STOCK INTEGRATED NETWORK USER EQUIPMENT HOLDER

BACKGROUND

1. Field of the Invention

Embodiments of the present invention generally relate to weapon stocks and more specifically to stocks specifically configured to receive a computer device.

2. Description of the Related Art

Rifles have stocks. Many of those rifles have adjustable stocks. Stocks are an integral part of the rifle that are typically near the armpit/shoulder of the rifle user.

There are instances when the rifle user needs to view/transmit data (or have access thereto) from/to a computer device while holding the rifle (and other equipment). For example, the data can be a mission update, send/receive pictures, send/receive video, view maps, and/or receive/transmit GPS data.

For the rifle user's safety/efficiency there often needs to be little time that it takes the rifle user to move back and forth between the computer device and obtaining/maintaining a "ready position."

One option is for the rifle user to hold the computer device. However, this approach requires the user to either continually hold the computer device or remove/insert the computer device from/into it's storage location. When utilizing this option, the rifle user can be distracted and looses valuable time acquiring the ready position.

Another approach is to add a separate accessory holder that mounts onto an existing stock. This approach typically requires that the computer device (e.g., phone) have a commercial available off-the-shelf phone case/enclosure inserted into the accessory holder. This approach is unwieldy, overly bulky, and ultimately degrades the user's ability to sight and fire the weapon.

There is a need for a design that eliminates the need for additional bulk and extra pieces to mount/access a computer device. There is a need for a design that is smaller, lighter, and ultimately more integrated with the rifle user experience.

SUMMARY

Embodiments of the present invention generally relate to weapon stocks and more specifically to stocks specifically configured to receive a computer device. For example, in one embodiment the stock includes an upper portion. The upper portion includes a proximal end and a distal end. A front portion and a rear portion are connected to the proximal end and the distal end of the upper portion, respectively. A bottom portion is connected to the front portion and rear portion. A first sidewall and a second sidewall are connected to the upper portion, the front portion, the rear portion, and the bottom portion. A channel is provided between the first and second sidewall. The upper portion, the front portion, the rear portion, and the bottom portion further define the channel. The first and second sidewalls include openings for accessing a computer device residing in the channel.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 7 depicts a rear side perspective view of the exemplary weapon stock in accordance with aspects disclosed herein;

FIG. 8 depicts a rear view of the exemplary weapon stock in accordance with aspects disclosed herein;

FIG. 12 depicts a perspective view of an exemplary button in accordance with aspects disclosed herein;

FIG. 13 depicts another perspective view the exemplary button in accordance with aspects disclosed herein; and FIG. 14 depicts another perspective view of the exemplary button, depicted in FIG. 13, in accordance with aspects disclosed herein.

To facilitate understanding, identical reference numerals have been used, wherever possible, to designate identical elements that are common to the figures.

DETAILED DESCRIPTION

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

Embodiments disclosed herein relate to weapon stocks that are adapted to receive a computer device (e.g., a cell phone or a personal data assistant ("PDA"), etc.) without significant interference of operation of the weapon or other equipment.

The rifle stock taught herein can be used alone without the rifle, it could act as a networked user equipment case, and without the networked user equipment it would serve as a functional stock.

The Outdoor Industry and Sporting Industry would be able to market this to hunters and sport shooters for carriage of their cell phones.

Figure 1:
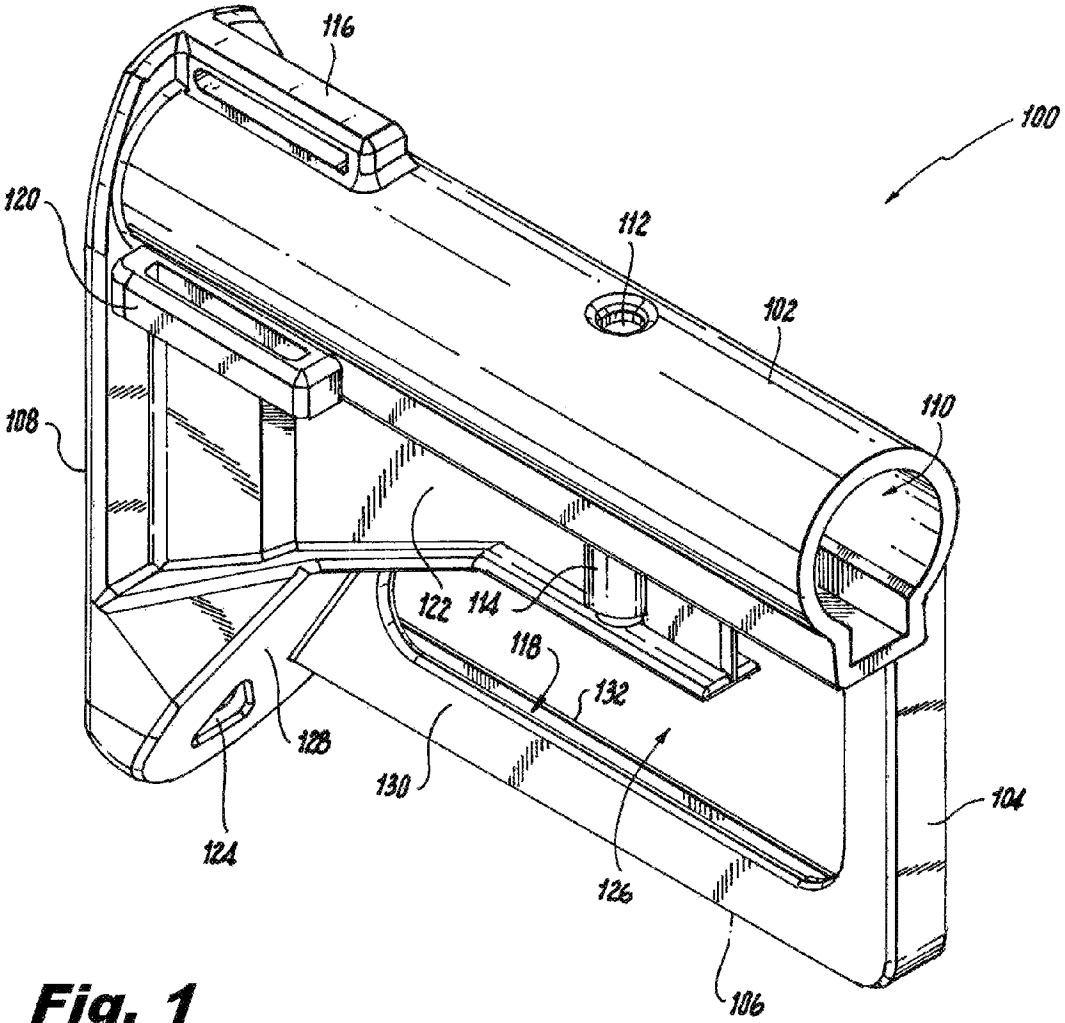
FIG. 1 depicts a perspective view of an exemplary weapon stock in accordance with aspects disclosed herein.

FIG. 1 depicts a perspective view of an exemplary weapon stock 100 in accordance with aspects disclosed herein. For illustrative purposes only, the weapon stock 100 is described (and depicted) herein as a weapon stock that is adapted for use with an M4 Carbine type weapon. However, that description/depiction (and other descriptions/depictions herein) is not intended in any way to limit the scope of the material taught herein. For example, in various embodiments, the weapon stock 100 is utilized with other devices (e.g., an M16 type device, a rifle utilizing a non-collapsible stock, a collapsible stock, etc.).

Various methods can be used to make the weapon stock 100 (e.g., 3D modeled and printed using a 3D printer). Returning to FIG. 1, the weapon stock 100 includes a buffer tube receiver 102, a front wall 104, a back wall 108, and a bottom wall 106.

The buffer tube receiver 102 includes an interior bore 110 that passes through the entire longitudinal axis of the buffer tube receiver 102. Substantially perpendicular to the longitudinal axis of the buffer tube receiver 102 is a threaded bore 112. The threaded bore 112 is an access point to install a spring loaded guide locking mechanism (not shown) for the weapon stock 100. Operation of the spring loaded guide locking mechanism is described in greater detail below.

The buffer tube receiver 102 also includes slot 116 and slot 120. Slot 116 and slot 120 are rear attachment points and are adapted to receive one end of a sling (not shown) for carrying the weapon. A corresponding slot (not shown), positioned near the barrel of the weapon, acts as a front attachment for the sling.

Connected to the buffer tube receiver 102 is an upper bracket 122. The upper bracket 122 provides structural support and strength to the weapon stock 100. The upper bracket 122 includes a quick release rocker 114 that it also connected to (and extends from) the buffer tube receiver 102.

The quick release rocker 114 is hollow so that a spring (not shown) can reside therein. The quick release rocker 114 has a longitudinal axis that is substantially perpendicular to the longitudinal axis of the buffer tube receiver 102. The longitudinal axis of the quick release rocker 114 is aligned with a longitudinal axis of the threaded bore 112.

The buffer tube receiver 102, the front wall 104, the bottom wall 106, and the back wall 108 form part of a boundary for cavity 126. In addition, a rear wall support 130 and a front wall support 132 are connected to and substantially perpendicular to the front wall 104, the bottom wall 106, and the back wall 108. The rear wall support 130 and the front wall 132 also form part of the boundary for cavity 126. The height (and strength) of the rear wall support 130 and front wall support 132 is sufficient to secure a device (not shown) within the cavity 126 without obscuring functionality of the device. Front support wall 132 and rear support wall 130 include access windows that allow access to the front (not shown) and back (not shown) of a computer device (not shown).

Between the rear support wall 130 and the front support wall 132 is a channel 118. The channel 118 includes four interior walls $\mathbf{118}_1$, $\mathbf{118}_2$, $\mathbf{118}_3$, and $\mathbf{118}_4$ that are collectively referred to herein as "channel 118." Inside the channel 118, the opposing interior walls are substantially parallel to one another (i.e., interior walls $\mathbf{118}_1$ and $\mathbf{118}_4$ are substantially parallel to one another and interior walls $\mathbf{118}_3$ and $\mathbf{118}_2$ are substantially parallel to one another.

In various embodiments, the cavity 126 and channel 118 are large enough to accommodate a computer device that is already in a protective case. Some protective cases provide added impact resistance while other cases provide greater protection against water damage. In these embodiments, the computer device would have two layers of protection (i.e., one layer of protection from the protective case and another layer of protection from the stock 100). For example, a PDA can be inside of a commercially available protective case. The PDA, while still in the protective case, can be inserted into the stock 100.

Figure 2:
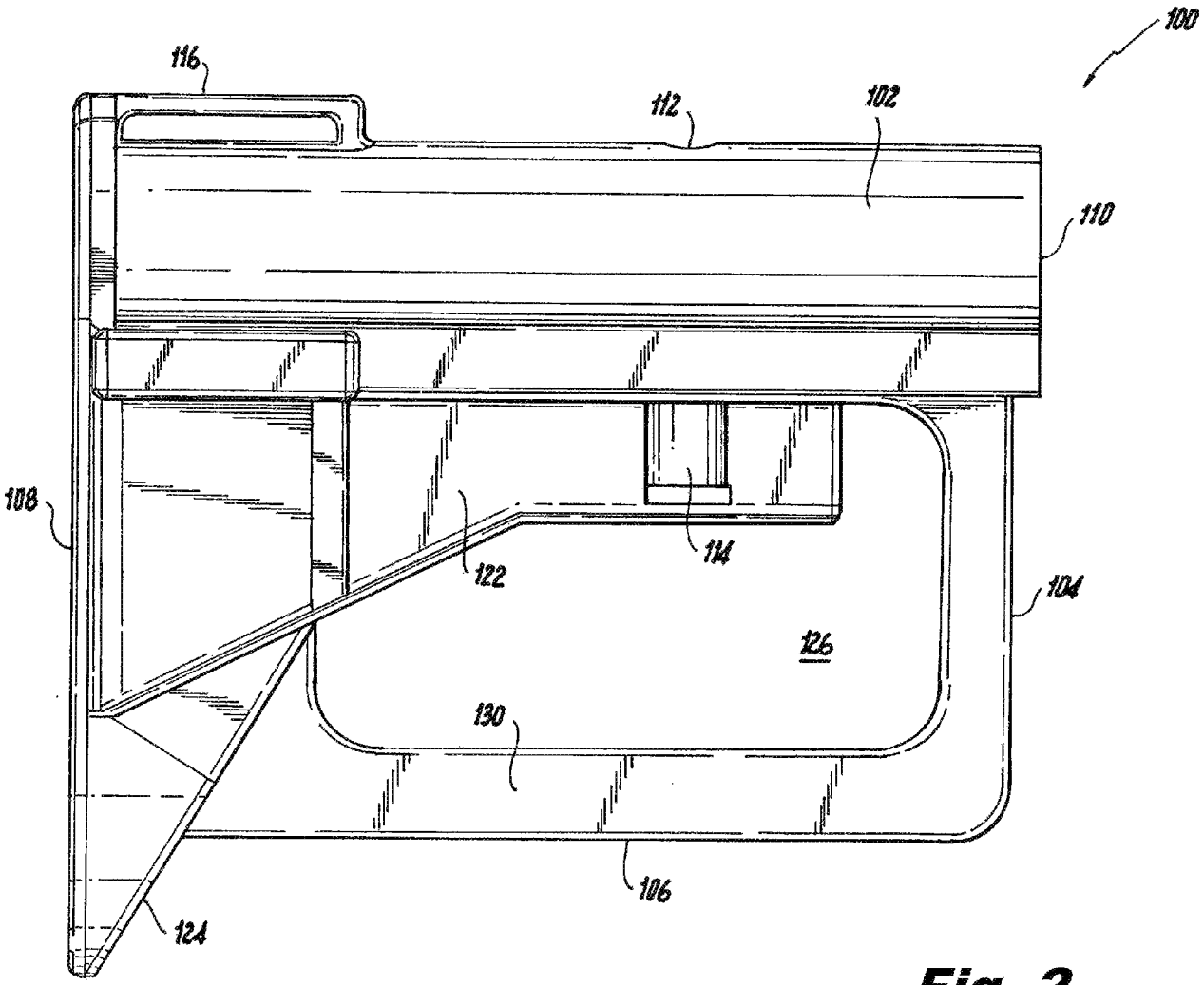
FIG. 2 depicts another perspective view of the exemplary weapon stock in accordance with aspects disclosed herein.

FIG. 2 depicts a left side perspective view of the exemplary weapon stock 100 depicted in FIG. 1.

Figure 3:
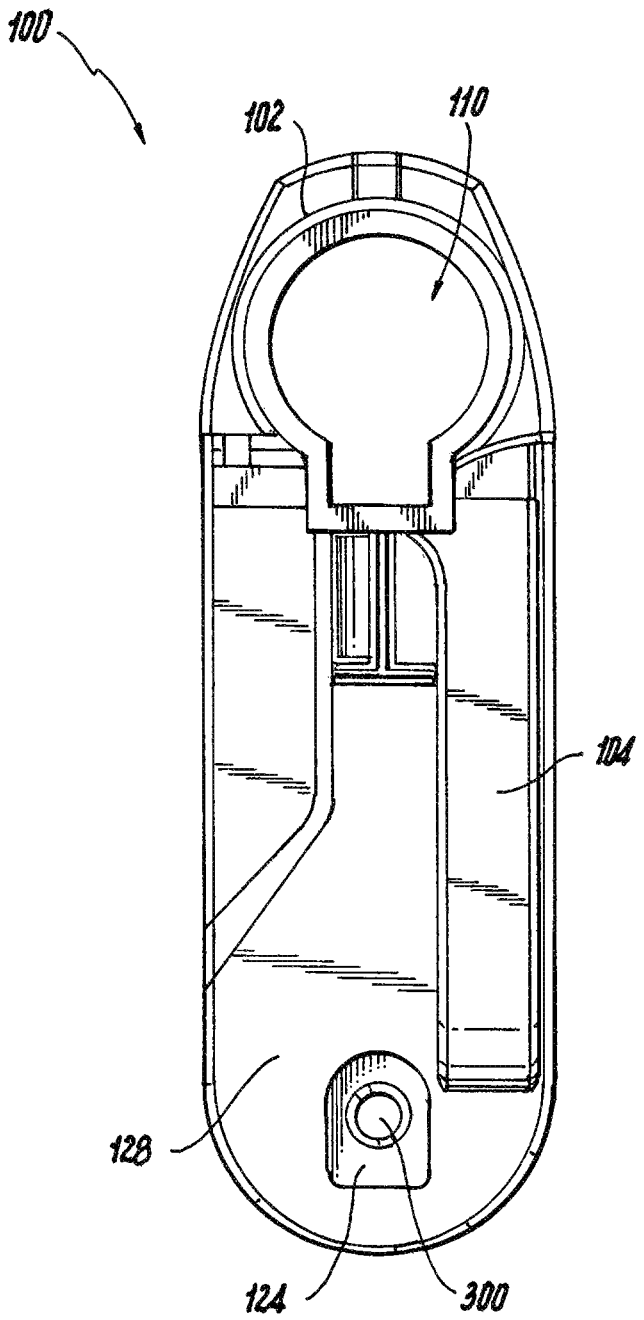
FIG. 3 depicts yet another perspective view of the exemplary weapon stock in accordance with aspects disclosed herein.

FIG. 3 depicts a front perspective view of the exemplary weapon stock 100 depicted in FIG. 1. FIG. 3 shows the baffle tube receiver interior 110. FIG. 3 also shows a bore 300 disposed within the cavity 124 on slanted wall 128. Cavity 124 is adapted to receive a sling connector (not shown) while bore 300 is used to secure the sling connector to the stock 100.

Figure 4:
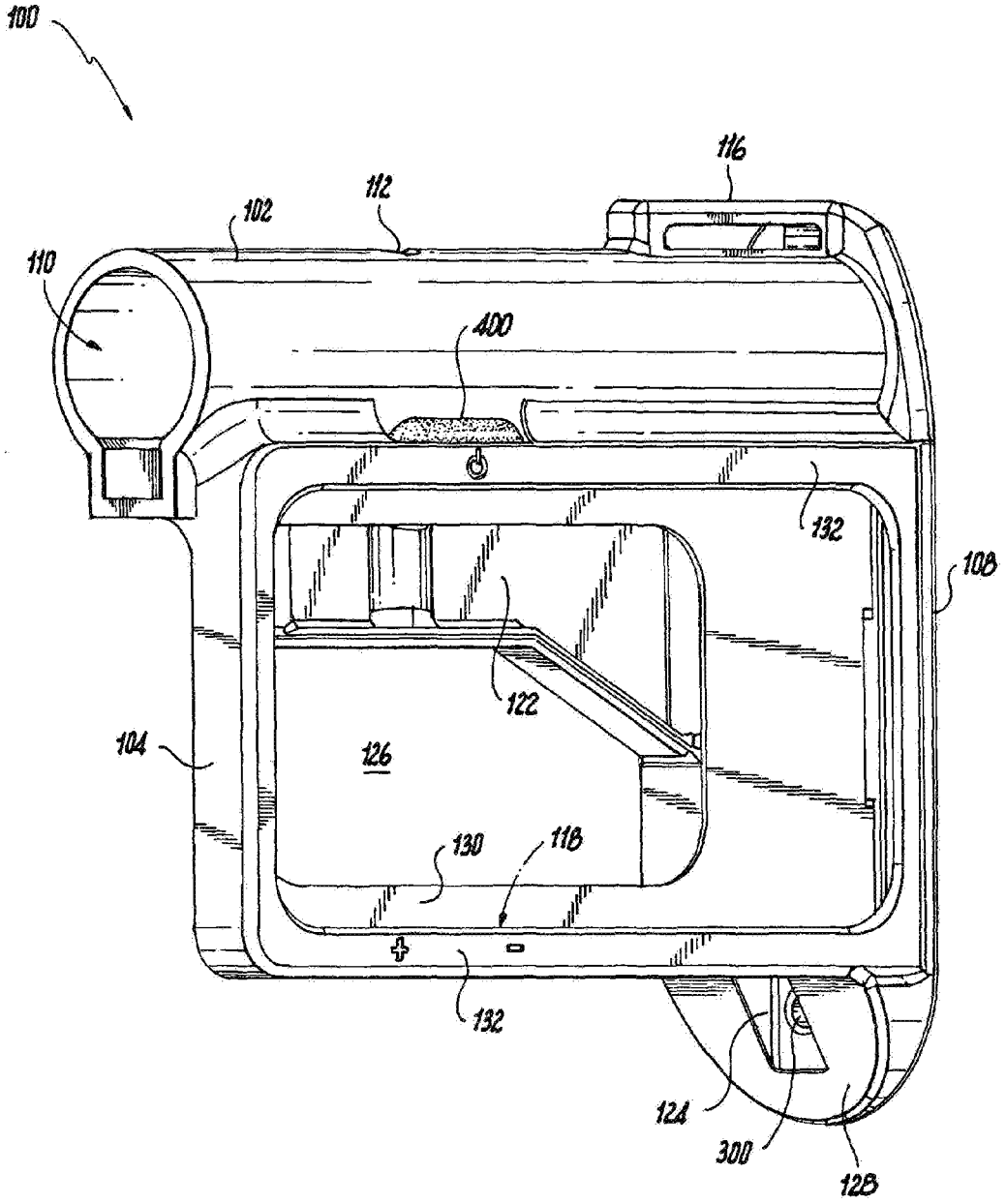
FIG. 4 depicts another perspective view of the exemplary weapon stock in accordance with aspects disclosed herein.

FIG. 4 depicts a right side perspective view of the exemplary weapon stock 100 depicted in FIG. 1. Specifically, FIG. 4 depicts the surface of rear support wall 130 on the inside of the cavity 126 and the surface of the front support wall 132 exposed to the exterior of the weapon stock 100. Also depicted on the right side of the weapon stock 100 is a power button 400 (explained in greater detail below).

Figure 5:
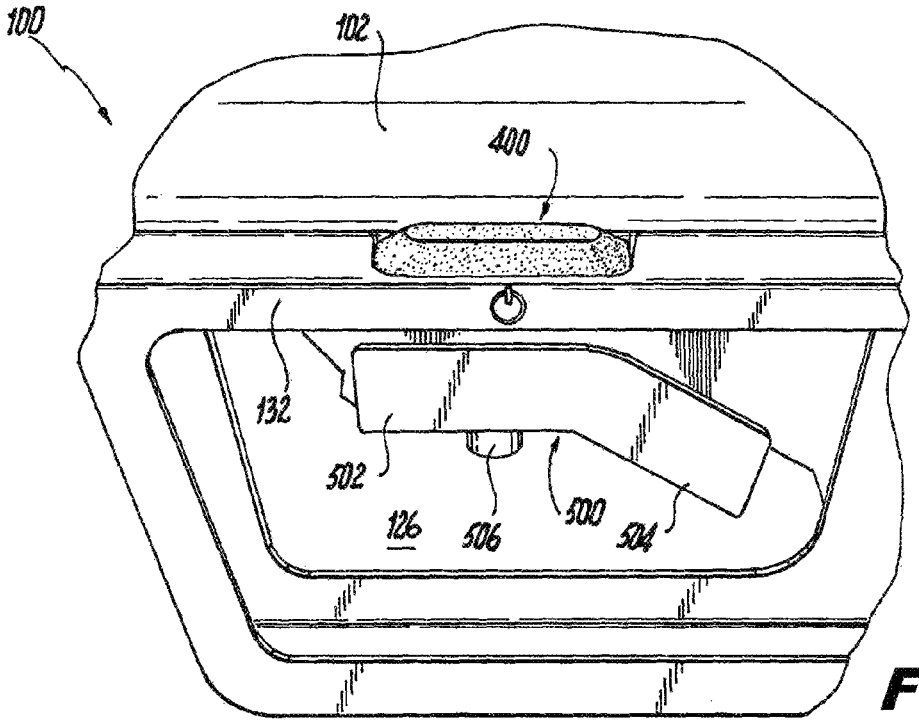
FIG. 5 depicts a close-up perspective view of the exemplary weapon stock in accordance with aspects disclosed herein.

FIG. 5 depicts a close-up perspective view of the exemplary weapon stock 100 in accordance with aspects disclosed herein. Specifically, FIG. 5 depicts a quick release lever 500 that is secured to the weapon stock 100 by a spring loaded locating pin 506. The quick release lever 500 includes an arm 502 and a handle 504. The quick release lever 500 is used to adjust the position of the weapon stock 100 on a the buffer tube 102. The handle 504 can be rotated counter-clockwise to cause the arm 502 to correspondingly rotate. The arm 502 urges the spring loaded locating pin 506 downward.

Figure 6:
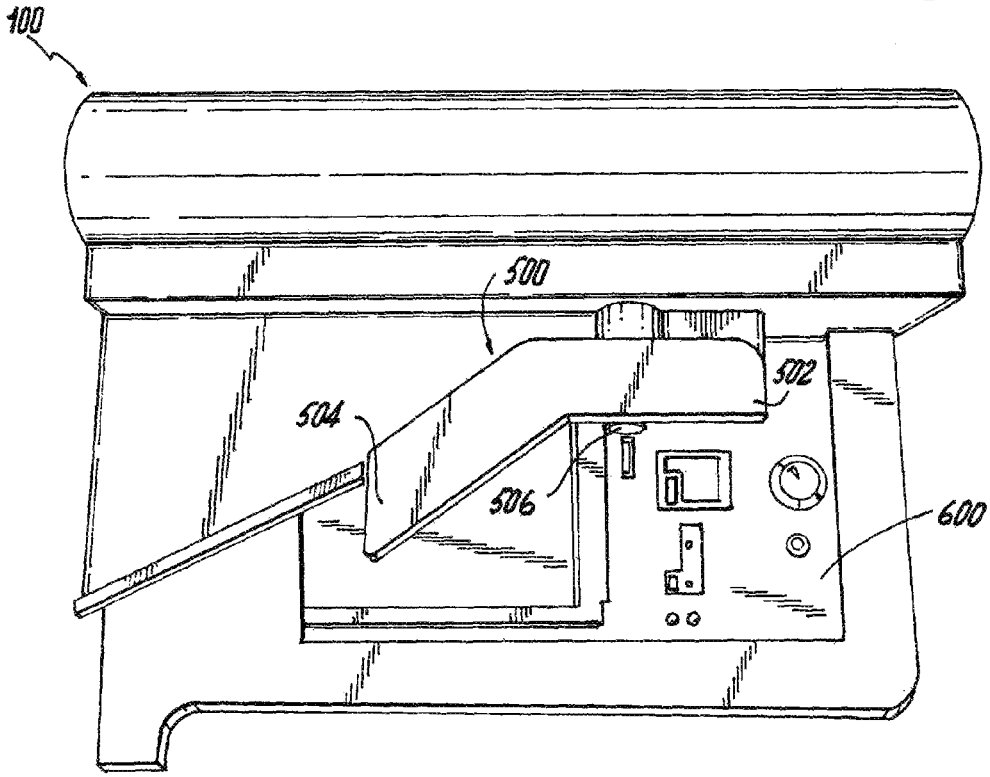
FIG. 6 depicts another close-up perspective view of the exemplary weapon stock in accordance with aspects disclosed herein.

FIG. 6 depicts another close-up perspective view of the exemplary weapon stock 100 in accordance with aspects disclosed herein. For illustrative purposes, a smartphone 600 is depicted in the channel 118 and between the back support wall 130 and front support wall 132 (i.e., inside the cavity 126).

FIG. 7 depicts a rear side perspective view of the exemplary weapon stock 100 in accordance with aspects disclosed herein. Specifically, FIG. 7 depicts the cavity 126, the interior surface of the rear support wall 130, the front support wall 132, and the channel 118 that is between the front support wall 132 and the rear support wall 132.

Secured to the channel 118 are cushioned supports 704. The cushioned supports 704 can be secured to at least one of the interior walls (i.e., $\mathbf{118}_1$, $\mathbf{118}_2$, $\mathbf{118}_3$, and/or $\mathbf{118}_4$) within the channel 118. For example, a cushioned support 704 can be secured to interior wall $\mathbf{118}_1$ and $\mathbf{118}_4$. Note that in FIG. 7, interior wall $\mathbf{118}_4$ is not visible. Interior wall $\mathbf{118}_4$ is the opposing inside wall on back door 700.

The back door 700 is depicted in a "closed" position. Back door 700 includes pinch clips 702 that when pinched together allows placing of the back door 700 in an "open" position.

FIG. 8 depicts a rear view of the exemplary weapon stock 100 in accordance with aspects disclosed herein. FIG. 8 depicts a screw 800 for insertion into bore 300 to hold an alternative sling mount (e.g., a "D" shaped ring).

Figure 9:
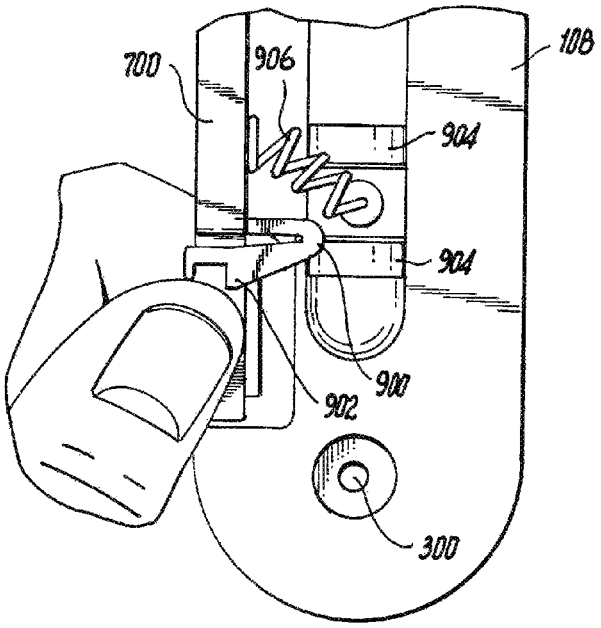
FIG. 9 depicts a perspective view of an exemplary door in accordance with aspects disclosed herein.

FIG. 9 depicts a perspective view of an exemplary door 700 in accordance with aspects disclosed herein. The door 700 is depicted in an "open" position and is sufficient in size to allow insertion/extraction of a computer device (e.g., a PDA, "smartphone," networked device, etc.) into/out of the cavity 126. Each of the pinch clips 702 (located on the outside of door 700) includes a "V-shaped" distal end 900 and an extended member 902. Each V-shaped distal end 900 acts to bias the extended member 902 to an "at rest" position. Back wall 108 includes cavities 904 that are adapted to receive the V-shaped distal ends 900 (when the pinch clips 702 are pinched). When the pinch clips 702 are released (while the V-shaped distal ends 900 are in the cavities 904, the bias exerted by the V-shaped members 900 causes the extended members 902 to engage a portion of the back wall 108 and "lock" the door 108 in a "closed" position. In short, the extended members 902 act as a latching mechanism with the back wall 108.

When a sufficient pinching force is applied to the pinch clips 702, the extended members 902 move from the at rest position to a "pinched" position. While in the pinched position, the extended members 902 are no longer in contact with the back wall 108. Because the extended members 902 no longer impede movement of the door 700, the door 700 is free to open/close.

FIG. 9 also depicts an optional lanyard 906. One end of the lanyard 906 is attached to the door 700 and the other end of the lanyard 906 is attached to the back wall 108. The lanyard 906 helps to prevent loss of the door 700.

Figure 10:
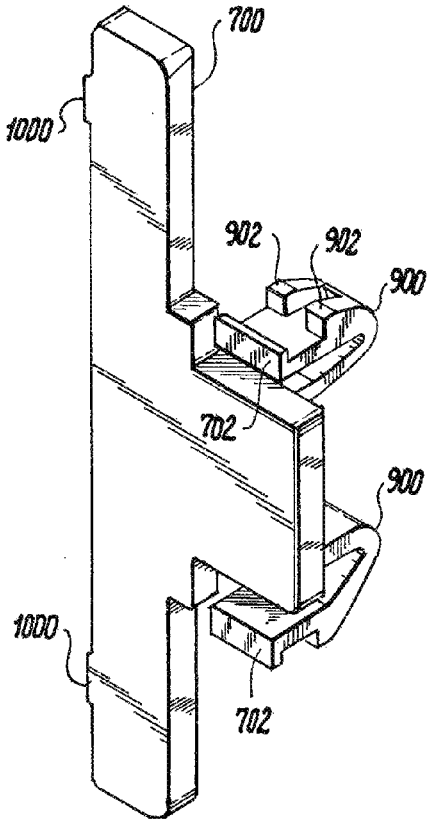
FIG. 10 depicts another perspective view of the exemplary door in accordance with aspects disclosed herein.

FIG. 10 depicts another perspective view of the exemplary door 700 in accordance with aspects disclosed herein. Specifically, FIG. 10 depicts the door 700 detached from the lanyard 906 and back wall 108.

Door 700 also includes a plurality of male members 1000. The male members 1000 act as stopping mechanisms and have corresponding female mating portions (not shown) on the back wall 108 of the stock 100. Although the FIG. 10 depicts the door 700 as having two male members 1000, it is appreciated that in various embodiments, the door 700 has one or more male members 1000.

In addition, the door 700 has been described herein as being mounted on the back wall 108. However, that description is for illustrative purposes only. It is appreciated that in various embodiments, the door 700 (and corresponding access into the stock 100) has a different mounting location on the stock 100.

For example, the door 700 (and corresponding opening for the door 700) can be mounted on the bottom wall 106, the front wall 104, the rear wall support 130, or the front wall support 132. In addition, in other embodiments, the door 700 utilizes a lock other than the pinch clips depicted. For example, in various embodiments, the locking mechanism is at least one screw in the door 700 and back wall 108; or a sliding latch.

Figure 11:
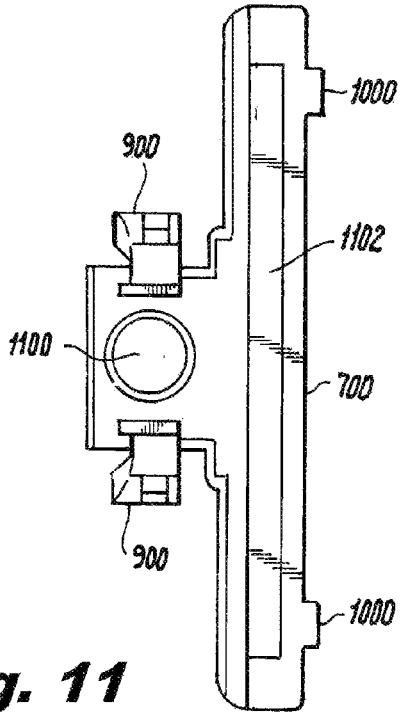
FIG. 11 depicts yet another perspective view of the exemplary door in accordance with aspects disclosed herein.

FIG. 11 depicts yet another perspective view of the exemplary door 700 in accordance with aspects disclosed herein. Specifically, FIG. 11 depicts the inside of the door 700 (i.e., interior wall $\mathbf{118}_4$). The inside of the door 700 includes a relief section 1100 and a relief section 1102.

The relief sections 1100 and 1102 are essentially recessed areas that are adapted to receive an item. For example relief section 1100 is adapted to receive cushioned supports (e.g., cushioned support 704). Note that each interior walls $\mathbf{118}_1$, $\mathbf{118}_2$, $\mathbf{118}_3$, and $\mathbf{118}_4$ can include a relief section 1100 that is adapted to have a cushioned support 704 attached thereto.

Relief section 1102 is a connection location for the lanyard 906.

FIG. 12 depicts a perspective view of an exemplary button in accordance with aspects disclosed herein. Illustratively, the button is depicted as a single button control button and is described herein as power button 400. Power button 400 can be made of any pliable and durable material (e.g., rubber).

The power button 400 includes multiple features. For example, surface 1200 has a size and shape sufficient for a user to depress.

A flanged surface 1202 is around the periphery of surface 1200. The flanged surface 1202 is contoured to define the surface 1200 and to act as part of a securing mechanism to secure the power button 400 in a cavity (not shown) in the stock 100.

The power button 400 also includes a recessed ring 1204 and a gasket 1206. The recessed ring 1204 is located around the periphery of the power button 400 and is between the flanged surface 1202 and the gasket 1206.

The power button 400 is inserted into a cavity (not shown) in the stock 100. The cavity includes a protruding ring (not shown) that mates with the recessed ring 1204. The power button 400 is held in place by the protruding ring and those portions of the power button 400 that sandwich the recessed ring 1204 (i.e., the flanged surface 1202 and the stopper 1206).

The power button 400 also includes features not shown in FIG. 12. For example, on the interior (i.e., the underside) of the power button 400 is a recessed area (not shown). The recessed area allows the power button 400 to be positioned over a power button located on the computer device. The recessed area increases the likelihood that the power button on the computer device is actuated by the power button 400 when desired (and not unintentionally actuated).

FIG. 13 depicts another perspective view the exemplary button 1300 in accordance with aspects disclosed herein. Illustratively, the button 1300 is depicted as a two-button control button and is described herein as a volume control button 1300. Volume control button 1300 can be made of any pliable and durable material (e.g., rubber). The volume control button 1300 includes two protruding volume buttons $\mathbf{1304}_1$ and $\mathbf{1304}_2$ (collectively "volume buttons 1304"). One of the volume buttons 1304 is used to increase the volume of the computer device and the other volume button is used to decrease the volume of the computer device. The volume control buttons 1304 are defined by flanged surfaces 1308. The volume control buttons 1304 reside on gasket 1302. A recessed ring 1306 is located on the circumference of the volume control button 1300 and is between the gasket 1302 and a gasket 1310.

The volume control button 1300 is inserted into a cavity (not shown) in the stock 100. The cavity includes a protruding ring (not shown) that mates with the recessed ring 1306. The volume control button 1300 is held in place by the protruding ring and those portions of the volume control button 1300 that sandwich the recessed ring 1306 (i.e., the gasket 1302 and the gasket 1310).

FIG. 14 depicts another perspective view of the exemplary button, depicted in FIG. 13, in accordance with aspects disclosed herein. Specifically, FIG. 14 depicts the underside of the volume control button 1300 as having a recessed area 1400. The recessed area allows the volume control button 1300 to be positioned over a volume button (not shown) located on the computer device. The recessed area 1400 rests over the volume buttons on the computer device and prevents unintentional actuation by the volume control button 1300.

Figure 15:
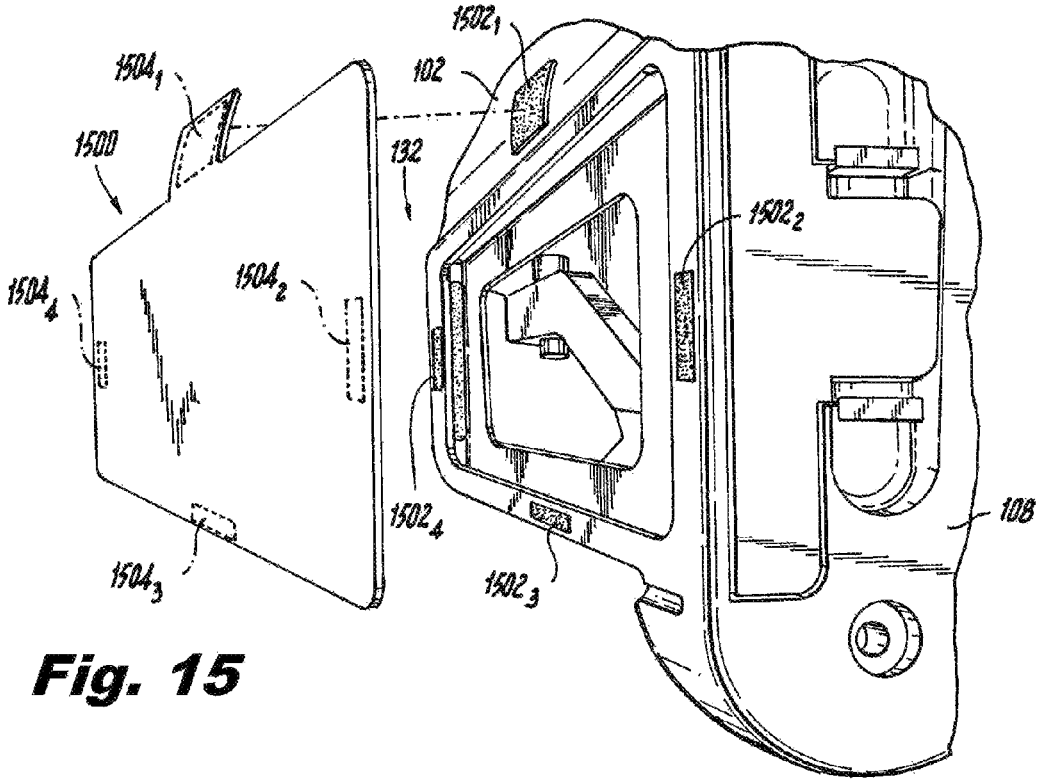
FIG. 15 depicts another rear side perspective view of the exemplary weapon stock in accordance with aspects disclosed herein.
Figure 16:
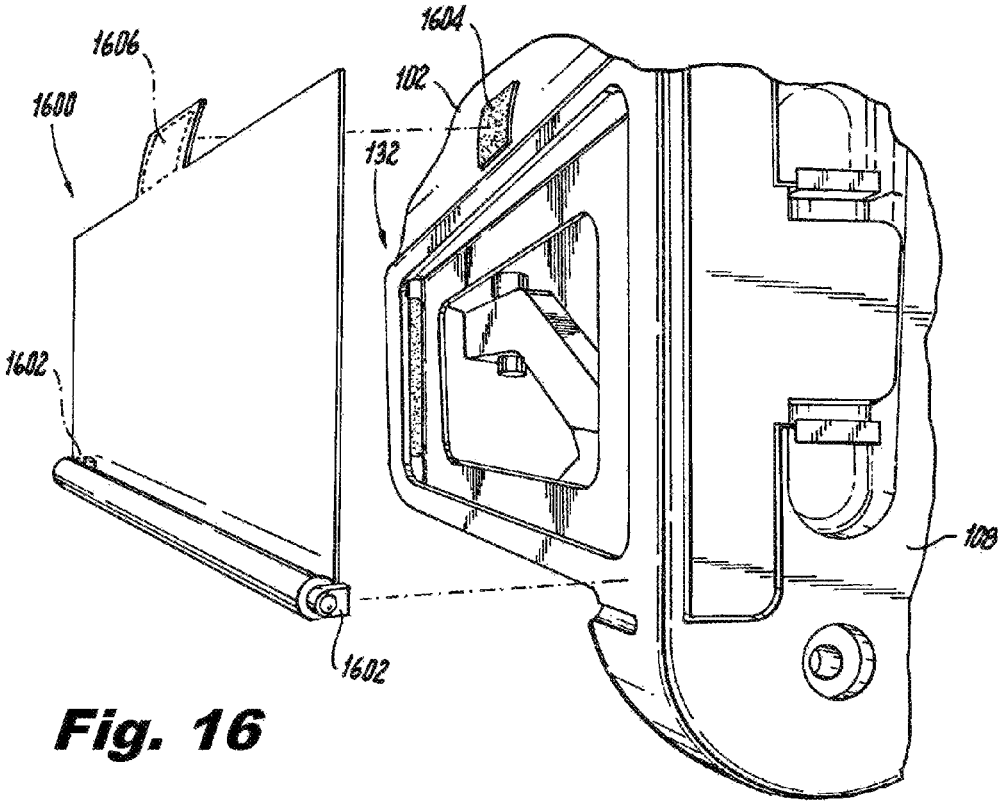
FIG. 16 depicts yet another rear side perspective view of the exemplary weapon stock in accordance with aspects disclosed herein.

In various embodiments, the stock 100 also includes a means of connecting a cover to the stock. For example, as shown in FIGS. 15 and 16, a mechanism (similar to the mechanism used in a "window shade") is used to spool a flexible flap 1600. The flap 1600 can be made of any flexible and durable material (e.g., CORDURA® fabric which is a registered trademark of INVISTA located in Wichita, Kans.). Further, the material can be an opaque material or a translucent material. Bosses 1602 on each end of the spool can secure the window shade type spool to the stock 100.

When the flap 1600 is not needed, the flap 1600 is pulled upon to cause the spool to retract the flap 1600 onto the spool. To use the flap 1600, the flap 1600 is pulled upon to extend the flap 1600 from the spool. An end of the flap 1600 can be secured to the stock 100 by a securing mechanism (e.g., a hook and loop fastener 1604 located on the stock 100 is mated to a corresponding hook and loop fastener 1606 on the end of the flap 1600).

In other embodiments, the flap 1500 is a piece of material (flexible or otherwise) secured on at least two ends to the stock 100. For example, hook and loop fasteners $\mathbf{1504}_1$, $\mathbf{1504}_2$, $\mathbf{1504}_3$, and $\mathbf{1504}_4$ (collectively "hook and loop fasteners 1504") located on ends of the flap 1500 mate with hook and loop fasteners $\mathbf{1502}_1$, $\mathbf{1502}_2$, $\mathbf{1502}_3$, and $\mathbf{1502}_4$ (collectively "hook and loop fasteners 1502") located on the stock 100. When not needed, a force is applied to the flap sufficient to overcome the mating of the hook and loop fasteners.

While the foregoing is directed to embodiments of the present invention, other and further embodiments of the invention may be devised without departing from the basic scope thereof, and the scope thereof is determined by the claims that follow.

What is claimed is:

1. A stock comprising:

an upper portion, wherein said upper portion includes a proximal end and a distal end;

a front portion connected to said proximal end of said upper portion;

a rear portion connected to said distal end of said upper portion;

a bottom portion connected to said front portion and said rear portion;

a first support wall connected to said upper portion, said front portion, said rear portion, and said bottom portion, wherein said first support wall includes a first access window; and a second support wall connected to said upper portion, said front portion, said rear portion, and said bottom portion, wherein said second support wall includes a second access window, and said first support wall, said second support wall, said upper portion, said front portion, said rear portion, and said bottom portion define a channel wherein said channel receives a computer device, and said first access window and said second access window define areas for access to said computer device:

further comprising a cover attached to said first support wall;

a spool attached to one end of said cover; and a fastener attached to an opposite end of said cover.

2. The stock of claim 1 further comprising a door on said stock.

3. The stock of claim 1 further comprising at least one button adapted to interface with said computer device.

4. The stock of claim 1 wherein said upper portion includes a buffer receiving tube.

5. The stock of claim 1 wherein said channel is adapted to receive said computer device inside of a protective enclosure.

6. The stock of claim 1 wherein said cover includes at least two fasteners adapted to mate with corresponding fasteners located on said first support wall.

7. The stock of claim 1 further comprising bosses attaching said spool to said first support wall.

* * * * *